US011052014B2

(12) United States Patent
Benet Pozo et al.

(10) Patent No.: US 11,052,014 B2
(45) Date of Patent: Jul. 6, 2021

(54) ABDOMINAL MASSAGE APPARATUS AND ABDOMINAL MASSAGE METHOD FOR RELIEVING CONSTIPATION

(71) Applicant: USMIMA, S.L., Cervelló (ES)

(72) Inventors: Marc Benet Pozo, Barcelona (ES); Maria Inmaculada Herrero Fresneda, Barcelona (ES); Angel Calzada Defez, Barcelona (ES); Markus Wilhelms, Barcelona (ES)

(73) Assignee: USMIMA, S.L., Cervelló (ES)

( * ) Notice: Subject to any disclaimer, the term of this patent is extended or adjusted under 35 U.S.C. 154(b) by 228 days.

(21) Appl. No.: 15/915,497

(22) Filed: Mar. 8, 2018

(65) Prior Publication Data

US 2018/0193220 A1 Jul. 12, 2018

Related U.S. Application Data

(63) Continuation of application No. PCT/IB2015/001576, filed on Sep. 8, 2015.

(51) Int. Cl.

| | |
|---|---|
| ***A61H 7/00*** | (2006.01) |
| ***A61H 9/00*** | (2006.01) |
| ***A61H 15/00*** | (2006.01) |

(52) U.S. Cl.

CPC ..... *A61H 7/007* (2013.01); *A61H 7/001* (2013.01); *A61H 9/0078* (2013.01); (Continued)

(58) Field of Classification Search

CPC ..... A61H 7/00; A61H 7/001; A61H 7/004; A61H 7/007; A61H 9/00; A61H 9/007; (Continued)

(56) References Cited

U.S. PATENT DOCUMENTS 1,147,560 A 7/1915 Shurtleff et al.
2,189,116 A * 2/1940 Niemiec ..... A61H 9/005 601/6

(Continued)

FOREIGN PATENT DOCUMENTS

CN 1168628 A 12/1997
CN 2489764 Y 5/2002

(Continued)

OTHER PUBLICATIONS

Translation of DE 3234825 (Year: 1988).*

(Continued)

*Primary Examiner* — Valerie L Woodward
*Assistant Examiner* — Paige Kathleen Bugg
(74) *Attorney, Agent, or Firm* — Edell, Shapiro & Finnan, LLC

(57) ABSTRACT

According to one implementation an apparatus is provided that comprises: one or more support plates with which there are associated massage units, the one or more support plates being secured to and facing an abdominal wall of the body of a patient; massaging heads integrated in the massage units for performing an abdominal massage on the patient, wherein at least two massaging heads are applied such that they are adjacent to at least one section out of an ascending section, transverse section or descending section of the colon of the patient thereby to apply a localized force generating a pressure on the colon section in a direction normal to the abdominal area, wherein the at least two massaging heads are synchronized; and control means for controlling the magnitude and timing of the localized force.

9 Claims, 9 Drawing Sheets

(52) U.S. Cl.
CPC ..... *A61H 2015/0042* (2013.01); *A61H 2201/0184* (2013.01); *A61H 2201/1215* (2013.01); *A61H 2201/1238* (2013.01); *A61H 2201/1246* (2013.01); *A61H 2201/149* (2013.01); *A61H 2201/165* (2013.01); *A61H 2201/1619* (2013.01); *A61H 2201/1664* (2013.01); *A61H 2201/1669* (2013.01); *A61H 2201/5012* (2013.01); *A61H 2201/5071* (2013.01); *A61H 2205/083* (2013.01)

(58) Field of Classification Search
CPC .... A61H 9/0021; A61H 9/005; A61H 9/0071; A61H 9/0078; A61H 9/0092; A61H 11/00; A61H 2011/005; A61H 2011/02; A61H 99/00; A61H 2201/0103; A61H 2201/0157; A61H 2201/12; A61H 2201/1207; A61H 2201/1215; A61H 2201/1238; A61H 2201/1246; A61H 2201/14; A61H 2201/1409; A61H 2201/149; A61H 2201/16; A61H 2201/1619; A61H 2201/1628; A61H 2201/165; A61H 2201/1657; A61H 2201/1664; A61H 2201/1669; A61H 2201/50; A61H 2201/5002; A61H 2201/5005; A61H 2201/5007; A61H 2201/5012; A61H 2201/5023; A61H 2201/5025; A61H 2201/5051; A61H 2201/5053; A61H 2201/5056; A61H 2201/5071; A61H 2205/083; A61H 2207/00
USPC ..... 601/151
See application file for complete search history.

(56) References Cited

U.S. PATENT DOCUMENTS

| | | | | |
|---|---|---|---|---|
| 3,071,133 | A | 1/1963 | Eisen | |
| 5,022,387 | A * | 6/1991 | Hasty | A61H 9/0078 601/152 |
| 6,099,488 | A | 8/2000 | Hung | |
| 6,238,423 | B1 | 5/2001 | Bardy | |
| 7,020,526 | B1 | 3/2006 | Zhao | |
| 7,591,797 | B2 | 9/2009 | Hakonson et al. | |
| 2004/0260216 | A1 * | 12/2004 | Zicherman | A61H 23/0254 601/111 |
| 2007/0255187 | A1 * | 11/2007 | Branch | A61H 7/001 601/15 |
| 2011/0087263 | A1 | 4/2011 | Arber | |
| 2012/0226208 | A1 * | 9/2012 | Schwaiger-Shah | A61H 9/0078 601/152 |
| 2013/0281897 | A1 * | 10/2013 | Hoffmann | A61B 8/0816 601/107 |
| 2015/0224012 | A1 * | 8/2015 | Wright | A61H 9/0078 601/150 |
| 2016/0242984 | A1 * | 8/2016 | Takagi | A61H 9/0078 |
| 2016/0296413 | A1 * | 10/2016 | Norman | A61H 9/0078 |

FOREIGN PATENT DOCUMENTS

| | | | | |
|---|---|---|---|---|
| CN | 201410093 | Y | 2/2010 | |
| CN | 201719512 | U | 1/2011 | |
| CN | 103330639 | A | 10/2013 | |
| CN | 203425225 | U | 2/2014 | |
| CN | 104739624 | A | 7/2015 | |
| CN | 204446549 | U | 7/2015 | |
| DE | 629816 | C | 5/1936 | |
| DE | 3238425 | A1 * | 4/1984 | A61H 9/0078 |
| DE | 3238425 | A1 | 4/1984 | |
| DE | 3622987 | A1 | 1/1988 | |
| DE | 102007045530 | A1 | 4/2009 | |
| DE | 102010022603 | A1 | 12/2011 | |
| FR | 2110790 | A | 6/1972 | |
| JP | 2015157004 | A | 9/2015 | |
| KR | 20110022190 | A | 3/2011 | |
| KR | 20110047794 | A | 5/2011 | |
| KR | 1354666 | B1 | 1/2014 | |
| KR | 101547595 | B1 | 8/2015 | |
| WO | 0132124 | A1 | 5/2001 | |
| WO | 2006014341 | A2 | 2/2006 | |

OTHER PUBLICATIONS

International Search Report and Written Opinion of the International Search Authority in corresponding PCT Patent Application No. PCT/IB2015/001576, dated Apr. 1, 2016.

* cited by examiner

ABDOMINAL MASSAGE APPARATUS AND ABDOMINAL MASSAGE METHOD FOR RELIEVING CONSTIPATION

CROSS-REFERENCE TO RELATED APPLICATIONS

This application relates to and claims the benefit and priority to International Application No. PCT/IB2015/001576, filed Sep. 8, 2015.

FIELD

The present invention generally relates to methods and apparatuses for treating intestinal-type problems. The invention particularly relates to an apparatus and to a method for performing an abdominal massage on the colon of a patient to treat these conditions.

BACKGROUND

Patent US-B1-7020526 discloses a non-invasive stimulation apparatus which introduces percutaneous pulsed electrical stimulation in circular fashion into and around the gastrointestinal tract for relieving intestinal problems such as constipation. Unlike patent US-B1-7020526, the present invention for relieving the mentioned intestinal problems and for relieving constipation, for example, performs an abdominal massage at a certain pressure of controlled magnitude which is applied consecutively along the entire course of the large intestine based on using a fluid dynamic system or an electromechanical system.

Patent application WO-A1-01/32124 also discloses an apparatus and a method for treating constipation. The apparatus includes a support member having at least one vibratory element attached to the support member. The mentioned apparatus further includes an actuator, which is attached to the vibratory element, and it moves for providing gastrointestinal peristaltic movements for relieving constipation. Unlike the present invention, patent application WO-A1-01/32124 does not allow performing an abdominal massage at a certain pressure of controlled magnitude and consecutively in the different areas of the colon, i.e., the ascending section, transverse section and descending section, of a patient.

Finally, patent KR-B1-101354666 discloses another device for performing massages in the abdominal area also for relieving constipation, for example. The mentioned device includes a unit for performing the massages which incorporates a rotary structure that turns with the help of a motor. In addition to the differences in size of the devices proposed in patent KR-B1-101354666 and in the present invention, the rotary structure performing the massage in the mentioned Korean patent is also unable to allow applying pressures of controlled magnitude continuously, and in specific areas, following the path of the colon of the patient primarily because it does not include at least one massage unit associated with a support plate.

Other examples of devices for performing an abdominal massage in which one or more massage units moving mechanically are applied can be found in documents U.S. Pat. No. 6,099,488, CN-A-103330639 and/or CN-A-1168628.

It therefore seems necessary to obtain apparatuses, and also methods, for abdominal massages that are small, transportable and precise, and that are able to reproduce manual massages given by medical professionals for treating intestinal problems (symptoms of constipation, for example).

SUMMARY OF THE DISCLOSURE

To solve the aforementioned drawbacks as well as others and to provide an apparatus for abdominal massages that is small, transportable and precise, that can be automatic, an also being able to reproduce manual massages given until now, a first aspect of the present invention provides an abdominal massage apparatus comprising: one or more support plates with which there are associated massage units, said one or more support plates being secured to and facing an abdominal wall of the body of a patient; massaging heads integrated in said massage units for performing an abdominal massage to the patient, wherein at least two massaging heads are applied such that they are adjacent to at least one section out of an ascending section, transverse section or descending section of the colon of the patient thereby to apply a localized force generating a pressure on said colon section in a direction normal to the abdominal area, and wherein said at least two massaging heads are synchronized; and control means for controlling the magnitude and timing of said localized force.

According to an embodiment, the at least two massaging heads are positioned close to at least two sections out of the ascending, transverse or descending colon.

According to another embodiment, the apparatus comprises three massaging heads which are positioned close to at least two sections out of the ascending, transverse or descending colon.

According to yet another embodiment, the apparatus comprises four massaging heads which are positioned close to at least two sections out of the ascending, transverse or descending colon.

The massaging heads are preferably located adjacently and aligned along the section or sections of the colon of the patient.

Moreover, according to the invention, said control means may manipulate each massaging head and synchronize the magnitude, sequence and frequency of actuation of each massaging head, making it possible to deliver multiple different massage sequence patterns such as pressure waves that progress longitudinally along the colon or turbulence pattern inside a specific section of the colon, or a standing wave in the colon, or a pressure difference along the colon or any combination of the above patterns who are applied, simultaneously.

Typical frequency of operation of each massaging head is planned to be between 0.1-0.9 cycles per second. However, the proposed apparatus is designed to deliver broader range of frequencies, 0.05-50 cycles per second, in order to enable variable treatment patterns during the treatment session. For instance, the patient might be advised to begin a treatment at higher frequency and reduce it gradually during the treatment session.

Furthermore, if a specific section of the colon is known to be an individual's dominant cause for constipation, the proposed invention enables specific treatment pattern to the diagnosed section, while the other sections of the colon are treated differently.

According to an embodiment, each of the massaging heads is an actuator providing the localized force as a cyclic force. In this case, said actuator is preferably a fluid driven actuator comprising a flexible casing which is inflated or deflated by pumping a fluid until providing said force, of controlled magnitude, in a given time period according to said certain sequence pattern.

The fluid for inflating or deflating the mentioned casing is preferably an aqueous fluid, air or another gas. Likewise, the pumping can comprise the intervention of a fluid dynamic drive. In this case, electrovalves electrically connected to a programmable central unit are incorporated for supplying or removing said pressurized fluid in a controlled manner in relation to said flexible casings for its inflation and deflation respectively. Alternatively, the fluid can be removed in a more passive manner, i.e., the fluid is removed by means of opening the electrovalves and with the help of the pressure applied by the abdomen of the patient him/herself.

The mentioned flexible casing can also comprise the association of several chambers which are superposed on, connected to and communicated with a central portion in the form of bellows. Preferably, said chambers have an oblong or cylindrical shape and are oriented transverse to the course of the section of the colon on which they are applied superposed thereon.

In addition, the support plate or plates can be attached to a belt, the latter comprising at least one band or tightening straps going around the waist of the patient and positioning the massaging heads such that they are adjacent to said section or sections of the colon of the patient.

The control means are preferably remote control means which may be operated by the patient. In addition, the control means may be powered by batteries or power supply. Alternatively, the control means may be arranged at least in part in said belt.

In a second aspect, present invention provides an abdominal massage method for relieving constipation, and also for intestinal gases. The proposed method comprises performing said abdominal massage on a patient by means of the actuation of massaging heads integrated in massage units. The mentioned massage units are associated with one or more support plates, which are secured to and facing an abdominal wall of the body of the patient.

Unlike the methods known in the state of the art, the proposed method comprises arranging at least two massaging heads adjacent to at least one section out of an ascending, transverse or descending section of the colon of the patient thereby to apply a localized force generating a pressure on the colon section in a direction normal to the abdominal area, said at least two massaging heads being synchronized to operate such that to progress along the section or sections of the colon of the patient and to enhance evacuation of the patient's colon.

According to an embodiment, the localized force is controlled to decrease in magnitude consecutively along the section or sections of the colon of the patient on which said massaging heads are applied in order to impose pressure gradient inside the colon.

According to an embodiment, the massaging heads perform on the area of application one or more consecutive and synchronized pressure actuations with the same or different magnitude and duration.

According to another embodiment, the massaging heads are synchronized to apply said localized forces coherently, i.e. in a unified way, to the abdominal surface adjacent to the ascending colon and to the abdominal surface adjacent to the descending colon and to the surface adjacent to the transverse colon of the patient in order to increase patient's intra-abdominal pressure.

According to yet another embodiment, the massaging heads are synchronized to apply said localized forces to progress consecutively on the abdominal surface from adjacent to the ascending colon towards the abdominal surface adjacent to the transverse colon and from the descending colon towards the surface adjacent to the transverse colon of the patient in order to enhance turbulence in the transverse colon.

The localized forces are preferably applied by inflating and deflating a chamber of the massaging heads at a given frequency. In an embodiment, said given frequency varies along the section or sections of the colon of the patient in order to enhance turbulence inside the colon.

The duration of the abdominal massage is variable; however, the duration of the massage will preferably be between 10 and 20 minutes per session and at least 1 session per day. During said period, one or more cycles of the abdominal massage with force/pressure of controlled magnitude will be applied in said section or sections of the colon of the patient, by operating the massaging heads, preferably but not limited to, in the clockwise direction.

BRIEF DESCRIPTION OF THE DRAWINGS

The foregoing and other features and advantages will be more fully understood based on the following detailed description of embodiments in reference to the attached drawings, in which.

DETAILED DESCRIPTION

Various embodiments of the invention are discussed in detail below. While specific embodiments are discussed, specific terminology is employed for the sake of clarity. However, the invention is not intended to be limited to the specific terminology so selected and it should be understood that this is done for illustration purposes only. A person of ordinary skill in the art will recognize that other components and configurations can be used without parting from the spirit and scope of the invention. Each specific element includes all technical equivalents that operate in a similar manner to accomplish a similar purpose.

Figure 1:
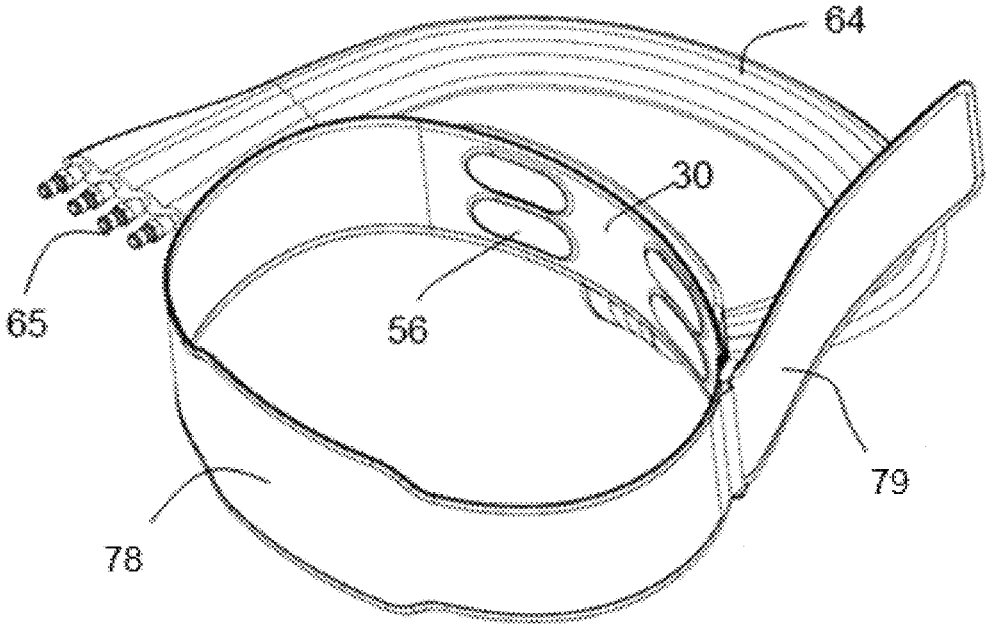
FIG. 1 is a schematic perspective view of an apparatus for performing an abdominal massage on a patient according to one embodiment of the present invention. In this case, the apparatus comprises four massaging heads for being applied when performing the abdominal massage adjacent to an ascending section and descending section of the colon of the patient.

FIG. 1 shows one embodiment of the abdominal massage apparatus on a patient 1 proposed in this invention. According to this embodiment, the apparatus consists of a single support plate 30 (which can be of any nature and more or less rigid) with which there are associated four adjacent and aligned massaging heads 56 (configured two by two), each integrated in a massage unit 10, and the massaging heads 56 are applied (when performing an abdominal massage) such that they are adjacent to each of the ascending section 21 and descending section 23 of the colon 20 of the patient 1.

Figure 4:
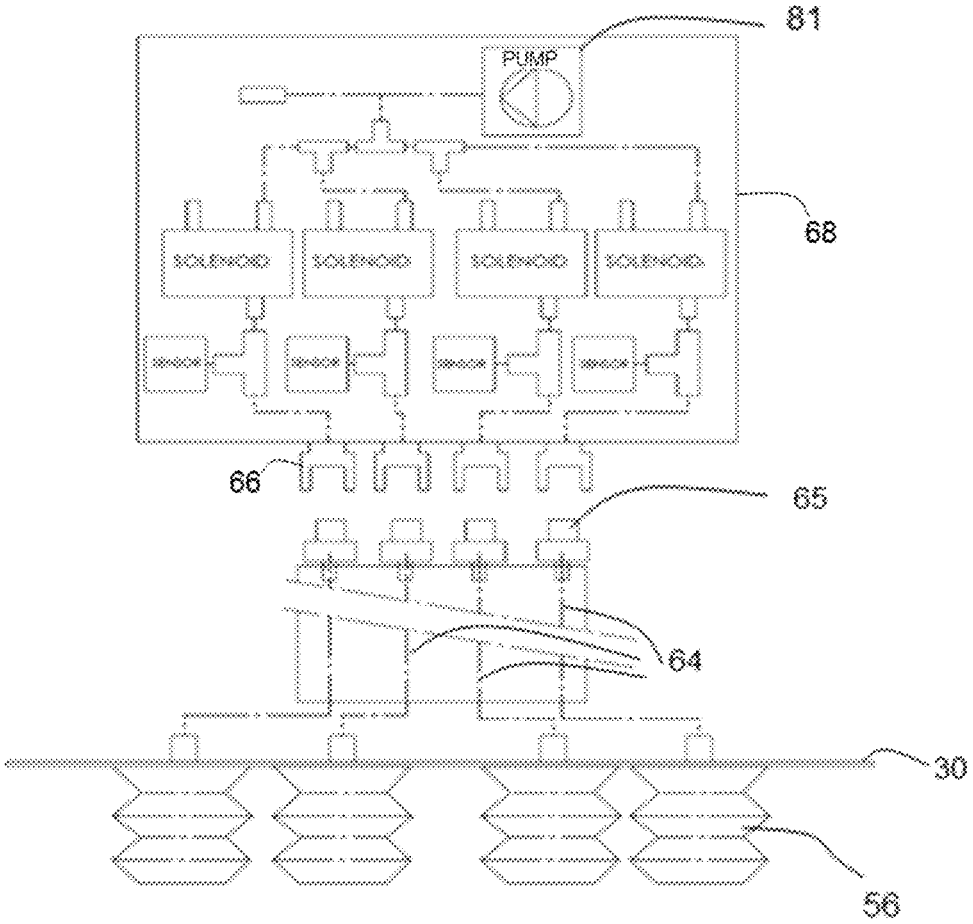
FIG. 4 illustrates the wiring diagram of the control means of FIG. 2 and the configuration of the different elements of the belt of the apparatus shown in FIGS. 1 and 3.

For performing the mentioned massage, each massaging head 56 applies a localized force or axial movement generating a pressure in a perpendicular, or normal, direction on the abdomen of the patient 1. Said massaging heads 56 can be driven by means of at least one fluid dynamic drive 81, for example, a pump, a piston or a pressurized fluid receptacle (see FIG. 4).

Figure 2:
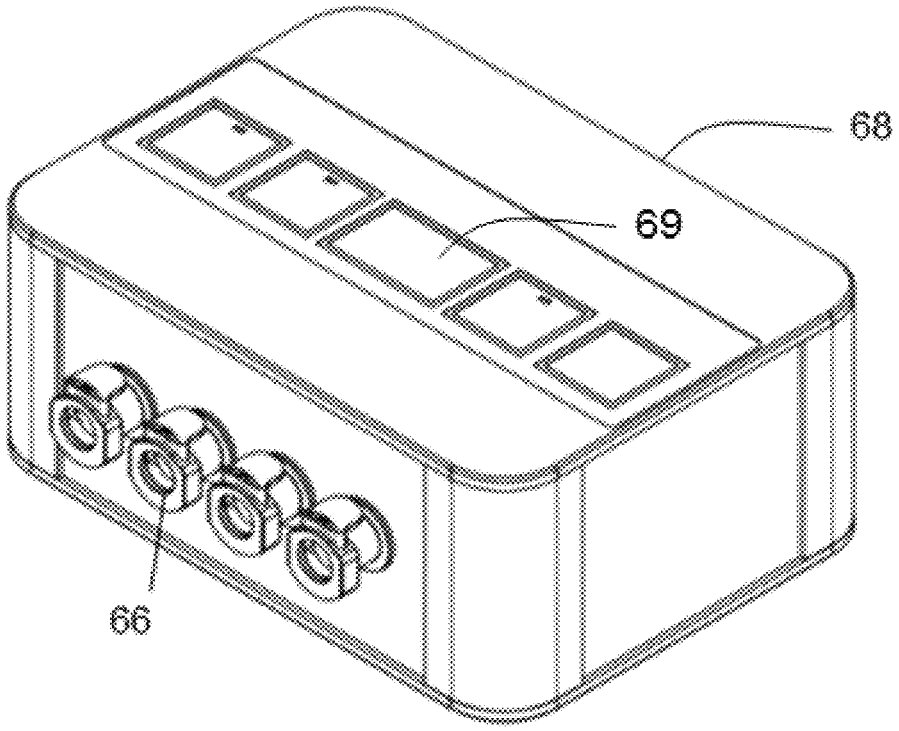
FIG. 2 shows one embodiment of the control means for controlling the abdominal massage apparatus of FIG. 1.

The operation of the massaging heads 56 is controlled by control means 68 (FIG. 2) which allow regulating by means of different control buttons/elements 69 the time and/or the speed of activation of each massaging head 56, and/or the pressure that they apply on the patient 1, and/or the time during which they apply the mentioned pressure, etc.

According to the embodiment of FIG. 1, the mentioned control means 68 control the massaging heads 56 (and as a result the massage units 10) by means of tubes/conduits 64 (for example, made of silicone or polyurethane) through which a fluid (aqueous fluid, air or another gas) passes, thereby allowing the operation of the massaging heads 56 for performing the abdominal massage. The mentioned tubes/conduits as seen in FIG. 1 are connected at one of their ends to the abdominal massage apparatus itself and include at the other end connectors 65 (male) that can be connected to the mentioned control means 68 (by means of respective female connectors 66). Alternatively, not illustrated in this case, the control means can be integrated in the abdominal massage apparatus itself. In this case, the control means comprise a control panel with control buttons integrated in the apparatus itself.

Figure 3:
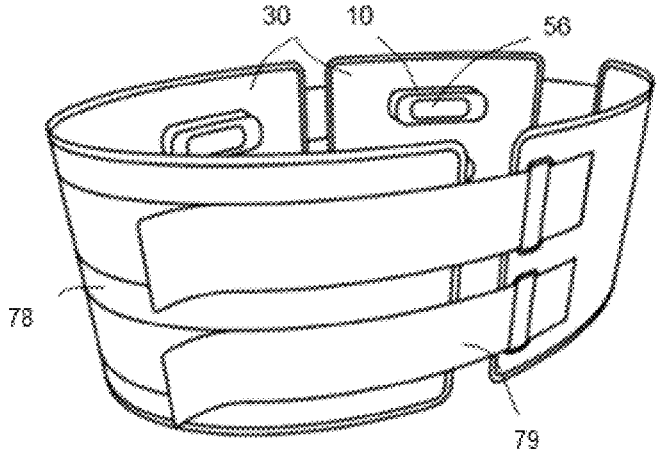
FIG. 3 is a schematic perspective view of an apparatus for performing an abdominal massage on a patient according to another embodiment.

FIG. 3 shows another embodiment of the abdominal massage apparatus proposed in this invention. According to this embodiment, the apparatus consists of two support plates 30, each having associated therewith two adjacent and aligned massaging heads 56, each integrated in a massage unit 10, and the massaging heads are applied (when performing the abdominal massage) such that they are adjacent to each of the ascending section 21 and descending section 23 of the colon 20 of the patient 1.

In the embodiments shown in FIGS. 1 and 3, the massage units 10 integrating the massaging heads 56 are fixed with respect to the support plate or plates 30, i.e., they do no move, nevertheless, these massage units 10 can be driven individually and alternately in a synchronized manner as a result of the mentioned control means 68. The support plate or plates 30 are also attached to a belt 78, the latter comprising at least one band or tightening straps 79 going around the waist of the patient 1 when performing the abdominal massage (which straps can be fastened in the front like in FIG. 1 or in the back like in FIG. 3, particularly in the event that they incorporate massaging heads 56 envisaged for being adjacent to a transverse section of the colon 20 of the patient 1) and they allow correctly positioning the massaging heads 56 such that they are adjacent to the mentioned sections of the colon 20 of the patient 1.

Figure 5A:
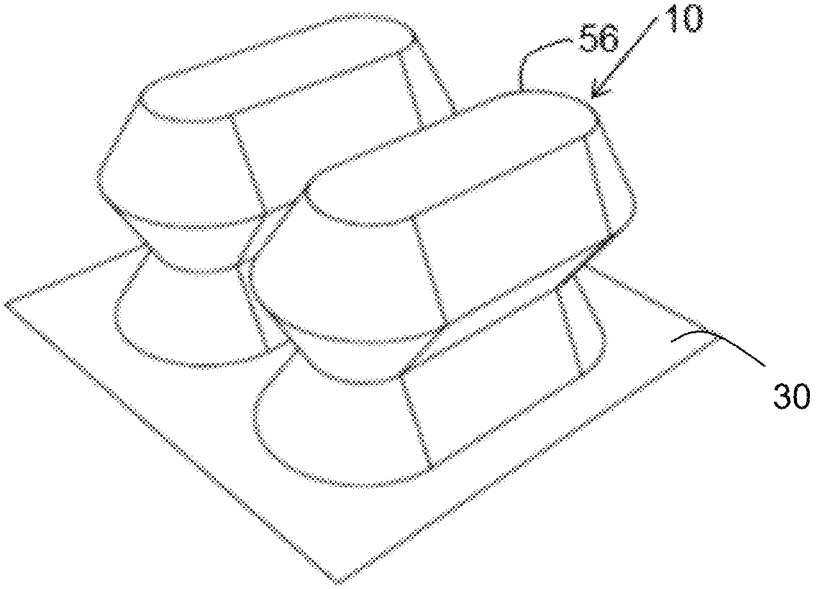
FIG. 5, views 5A and 5B, are a schematic perspective view (FIG. 5A) and plan view (FIG. 5B) of the massaging heads according to the embodiments of FIGS. 1 and 3.
Figure 5B:
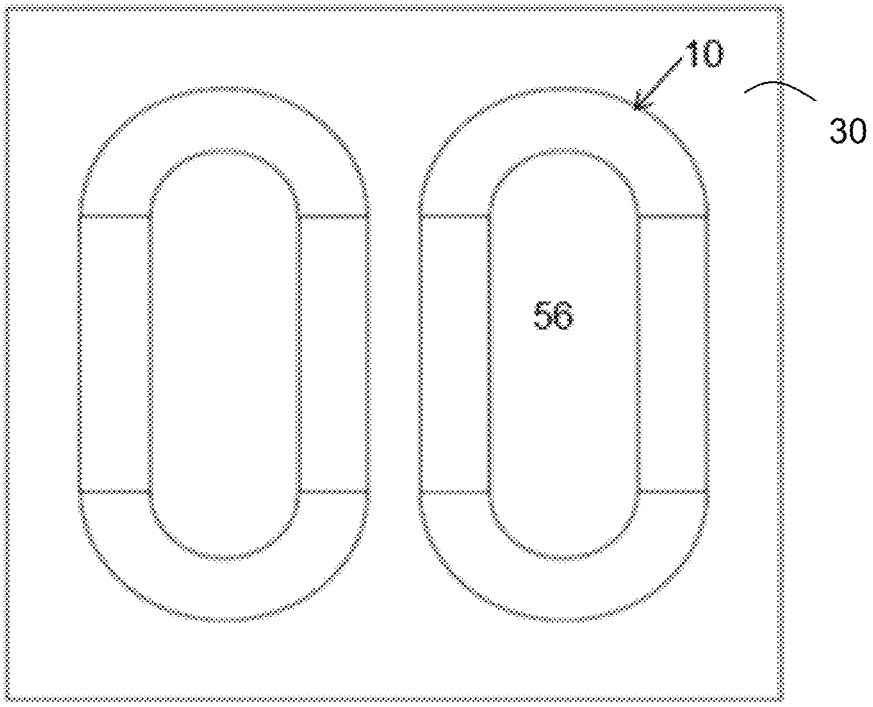

The massaging head 56 preferably comprises a flexible casing which is inflated or deflated by pumping of the mentioned fluid (aqueous fluid, air or another gas) until providing said force/pressure of controlled magnitude in a given time period. In a preferred embodiment, the flexible casing is formed by the association of several chambers which are superposed on, connected to and communicated with a central portion, forming a structure in the form of bellows. According to this preferred embodiment, said chambers can have an oblong shape (see FIG. 5 and embodiment of FIG. 3) or a cylindrical shape (embodiment of FIG. 1) and are oriented transverse to the course of the section of the colon 20 on which they are applied adjacent thereon.

The inflating/deflating operations can be carried out by the mentioned fluid dynamic drive 81. Furthermore, inflating and deflating of the massaging heads 56 can be controlled, for example, with electrovalves 82 (for example, three-way electrovalves) connected to a programmable central server (not illustrated). Alternatively, inflating of the massaging heads 56 can be controlled, for example, by means of opening the electrovalves 82, allowing the fluid stored in each actuator to come out during the opening thereof, the actual pressure of the abdomen of the patient 1 being what forces the fluid to be discharged outward.

The proposed abdominal massage apparatus can also include a power source, for example, batteries (not illustrated) for operating the different components of the apparatus. Nevertheless, the proposed abdominal massage apparatus can be powered by means of the direct connection thereof to the power supply.

Figure 6:
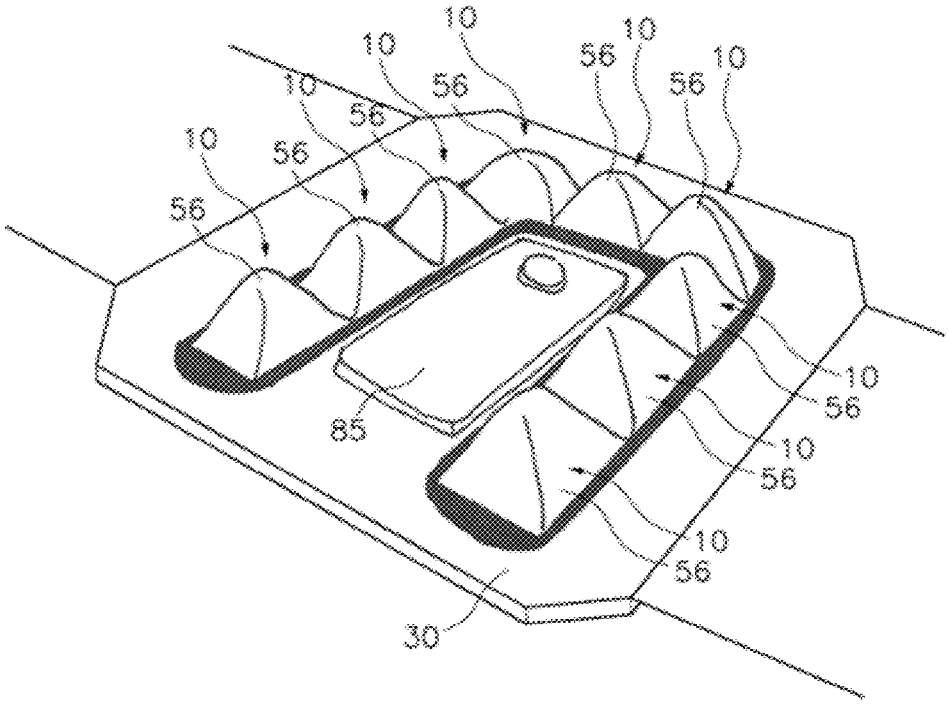
FIG. 6 is a perspective view of the abdominal massage apparatus according to another embodiment in which the massaging heads have been schematically depicted. In this case, the apparatus comprises a set of massaging heads applied such that they are adjacent to the ascending section, transverse section and descending section of the colon.

FIG. 6 shows another embodiment of the abdominal massage apparatus proposed in this invention. In this case, the apparatus comprises a support plate 30 on which there is arranged a set of massage units 10 formed by nine massage units (which have been schematically depicted and could be those illustrated in FIGS. 1 and/or 3), integrating the massaging heads 56 in the form of fluid driven actuators which, by means of a pressure of a fluid, inflate and deflate so as to allow performing the abdominal massage. In other words, this embodiment in relation to the embodiment of FIGS. 1 and/or 3 incorporates, in addition to an additional massaging head 56 in the support plate or plates 30 adjacent to the ascending section 21 and descending section 23 of the colon 20 of the patient 1 (i.e., three massaging heads 56 per ascending section 21 and descending section 23 of the colon 20), three other adjacent and aligned massaging heads 56, applied such that they are adjacent to the transverse section 22 of the colon 20 of the patient 1.

Figure 7:
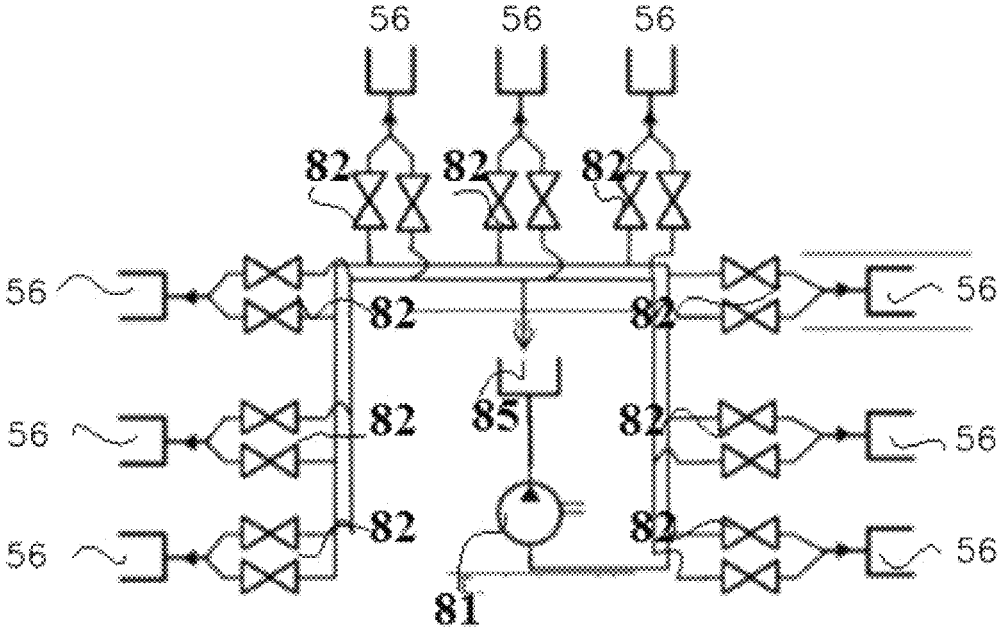
FIG. 7 illustrates the configuration of the different control elements of the apparatus shown in FIG. 6: electrovalves, pump, central reservoir, etc., and the connection between them.
Figure 8:
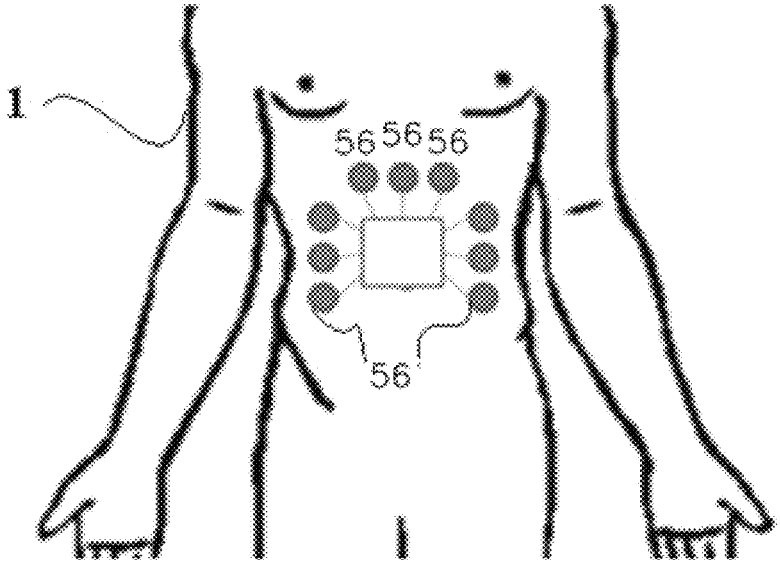
FIG. 8 shows the location of each of the massaging heads of the apparatus described in FIG. 6 with respect to the patient.

In this case, the fluid dynamic drive 81 can collect the fluid from a central reservoir 85 (FIG. 7) and deliver same to a channel which is connected to the massaging heads 56. Two electrovalves 82 regulating the passage of the aqueous or gaseous fluid are arranged between the channel and each massaging head 56.

The mentioned central reservoir 85 is preferably a flexible vessel made of a polymer film that can house the fluid needed so that the fluid driven actuators can operate. The central reservoir 85 can be manufactured with ultrasonically welded PU films.

In addition, to convey the fluid from the central reservoir 85 towards the fluid driven actuators forming the massaging heads 56, i.e., to carry out the pumping system, a system for inflating using pressure by means of a series of membranes is used. Inflation is produced by the action of the fluid forced to perform inflation by means of the pumping system. This pumping system (for example, a hydraulic or pneumatic pump) is what applies pressure and transmits thrust force to said massaging heads 56.

The abdominal massage apparatus proposed in this invention may comprise multiple massaging heads configurations (preferably in the form of fluid driven actuators). For example, according to another embodiment, in this case not illustrated for simplicity of the figures, the proposed abdominal massage apparatus in its simplest configuration comprises only two massaging heads (not limitative as a greater number of massaging heads are also possible) which are positioned on a single section the colon 20 of the patient 1, either the ascending 21, the transverse 22 or the descending 23 section, to perform the abdominal massage to the patient 1.

Besides that, other embodiments (not illustrated either) of the proposed abdominal massage apparatus disclose a 3×3 configuration (three massaging heads 56 such that they are adjacent to at least two sections of the colon 20, e.g. the ascending section 21 and the descending section 23), a 2×2×2 configuration (two massaging heads 56 such that they are adjacent to each of the ascending section 21, transverse section 22 and descending section 23 of the colon 20), a 3×3×3 configuration (three massaging heads 56 such that they are adjacent to each of the sections 21, 22, 23 of the colon 20), a 4×4 configuration, etc. The fluid driven actuators are preferably independent from one another, as illustrated in FIGS. 1, 3 and/or 6, nevertheless, in other alternative embodiments (also not illustrated) these actuators can even form a continuous tubular element with inflating or deflating in sections.

Figure 9:
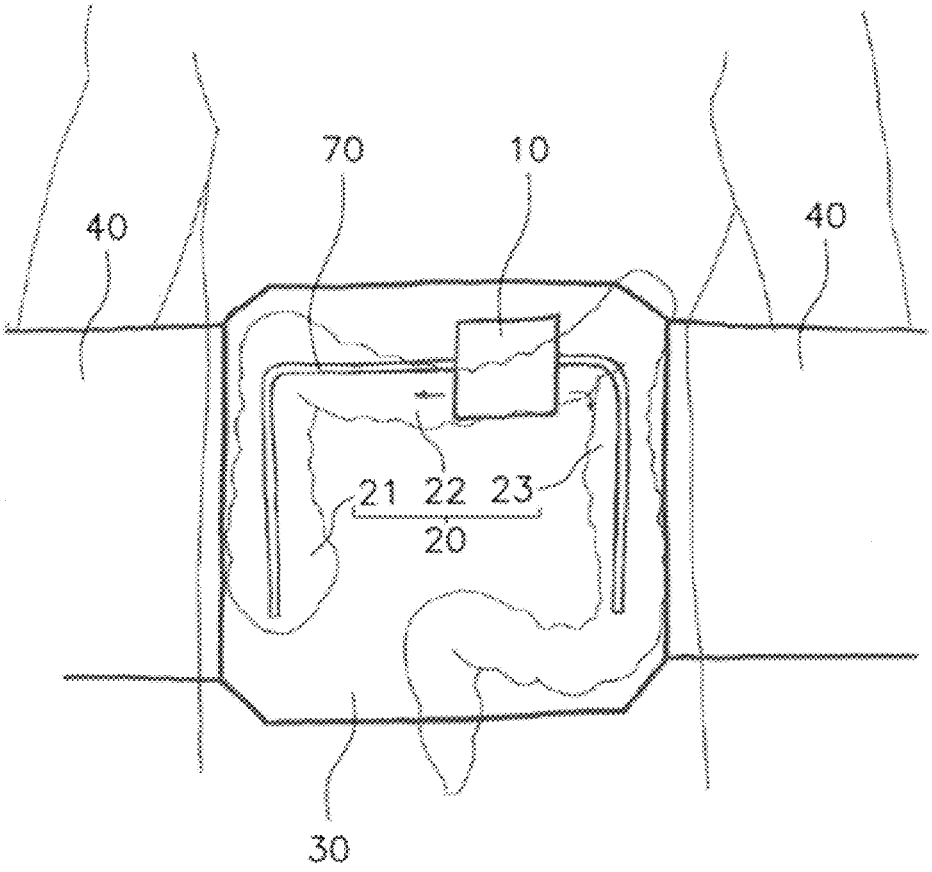
FIG. 9 is a schematic view of the abdominal massage apparatus according to one embodiment; in this case, the apparatus comprises a single massage unit provided with a mechanical drive.
Figure 10:
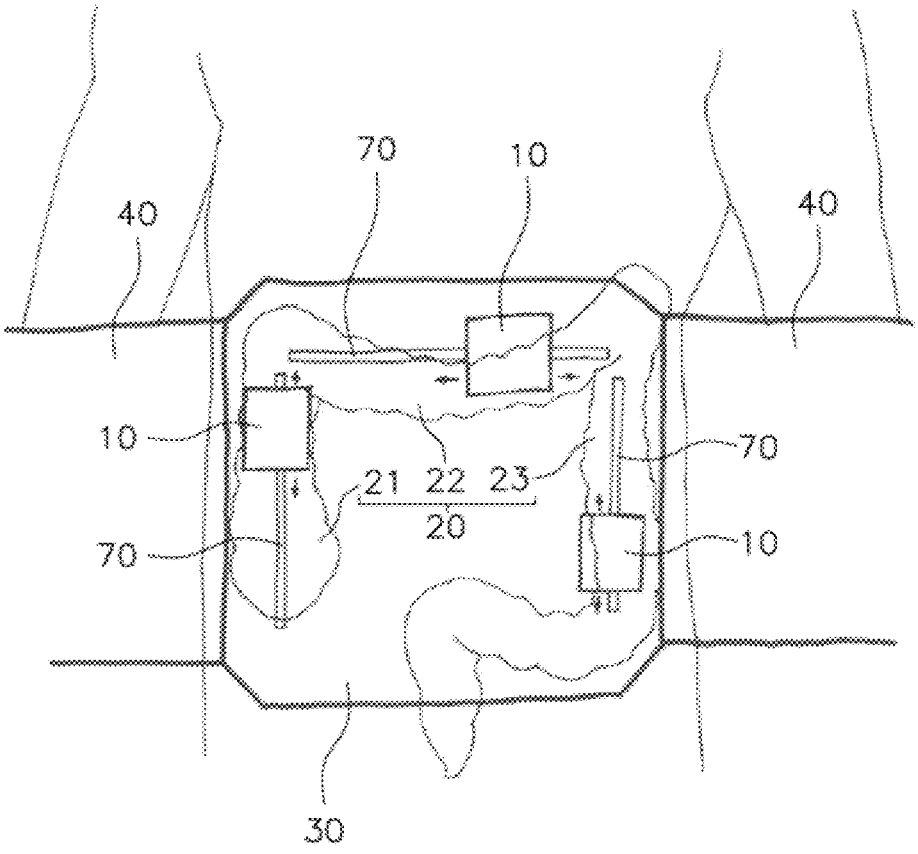
FIG. 10 is a schematic view of the abdominal massage apparatus according to another embodiment; in this case, the apparatus comprises three massage units provided with mechanical drives.
Figure 11:
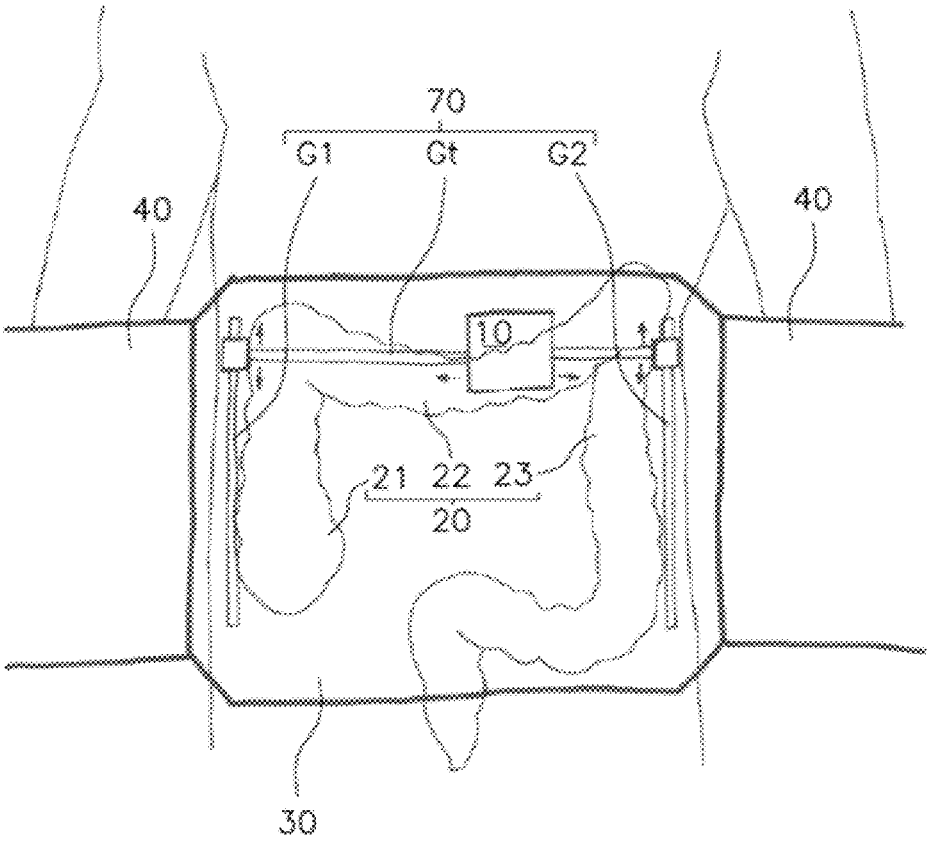
FIG. 11 is a schematic view of the abdominal massage apparatus according to one embodiment; in this case, the apparatus comprises a single massage unit provided with mechanical drives, which moves through the sections of the colon of the patient as a result of two parallel guides facing and spaced apart from one another.

FIGS. 9, 10 and 11 show other possible embodiments of the abdominal massage apparatus proposed in this invention, showing the position of the support plate 30 facing the abdomen of the patient 1 in its working position. In this particular case, the examples illustrated in FIGS. 9 and 11 consist of a single massage unit 10, whereas the example of FIG. 10 comprises three massage units 10. In the three embodiments, said massage units 10 are associated with guide means 70 which allow guided movement of said massage units 10 along a path coinciding with the ascending section, transverse section and descending section of the colon of the patient 1 to whom the mentioned support plate 30 has been fixed, said movement being driven by translational means 50.

Figure 12:
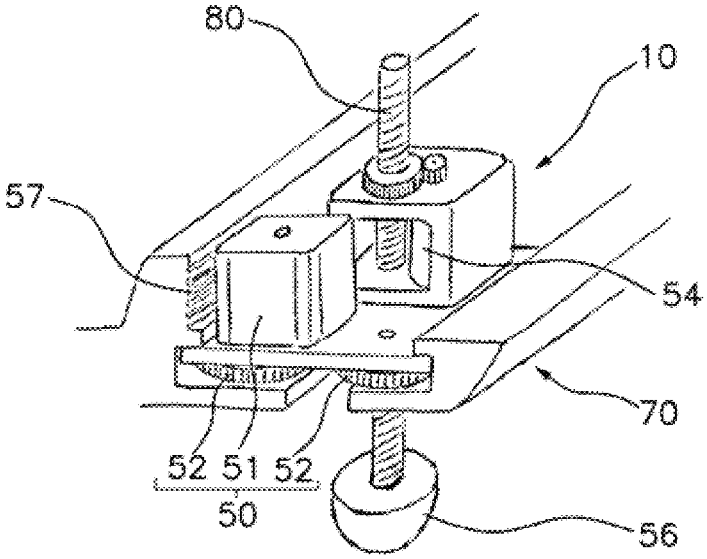
FIG. 12 illustrates one embodiment of the massaging head, mechanical drive, translational means and guide means used in the embodiments of FIGS. 9, 10 and/or 11. The translational means of this embodiment consist of a motor and gears engaging a rack-type toothed track arranged in the guide means, and the mechanical drive has a threaded shaft connected to a motor producing the pulsed translation thereof.
Figure 13:
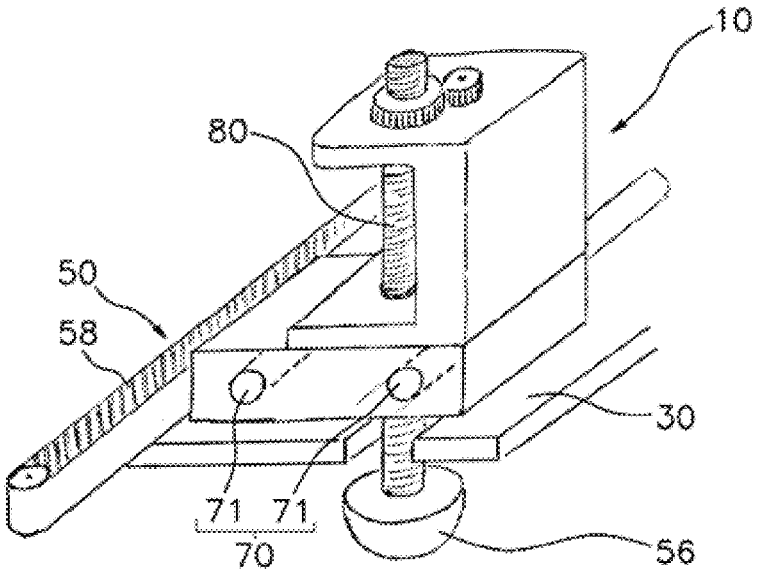
FIG. 13 illustrates another different embodiment of the massaging head, mechanical drive, translational means and guide means used in the embodiments of FIGS. 9, 10 and/or 11. The translational means of this embodiment consist of a motor (not shown) moving a belt connected to the massage unit, producing the dragging thereof.

By way of non-limiting example, the guide means 70 can consist of a C-shaped channel (see FIG. 12), or of one or two guide profiles 71 in the form of rails (see FIG. 13) on which the massage units 10 are anchored and slide. Said massage units 10 will preferably have bearings or wheels allowing them to slide on said guide means 70, and they will preferably have a coupling configuration preventing said massage unit 10 from separating from said guide means 70, without hindering the relative sliding thereof.

The movement of the massage unit 10 along the guide means 70 will be driven by translational means 50, which, by way of example, can consist of an electric motor 51 connected by means of gears 52 to a rack arranged along the guide means 70 (FIG. 12), or to a belt 58 (FIG. 13), or to a threaded shaft arranged along the guide means 70 (not shown), or to a combination of the former or other known translation methods. It will be obvious to a person skilled in the art that many other embodiments are possible. The mentioned translational means 50 can be controlled and/or regulated by means of the mentioned control means, or other complementary means, in a manner coordinated with the control and/or regulation of the massaging heads 56.

Therefore, the abdominal massage apparatus of FIGS. 9, 10 and 11 mainly comprises: a support plate 30 with which there is associated at least one massage unit 10; guide means 70, associated with said support plate 30, sized so that said at least one massage unit 10 is arranged superposed on the ascending section 21, transverse section 22 and descending section 23 of the colon 20 of the patient 1, for an abdominal massage; means 60 for moving said at least one massage unit 10 along said guide means 70 such that said massage unit 10 is arranged facing a treatment area including an abdominal wall of a patient 1; adjustable securing means 40 for adjustably securing the mentioned support plate 30 that go around the torso of the patient 1, positioning and maintaining the support plate 30 in said treatment area; a massaging head 56 integrated in said massage unit 10 for applying a pressure of controlled magnitude; and control means for controlling said movement of the massage unit 10 and said pressure of controlled magnitude.

In this case, the massaging head 56 is driven by means of a mechanical drive (FIGS. 12 and 13), so according to a preferred embodiment, the massaging head 56 consists of a threaded or toothed vertical shaft connected to a motor which makes the vertical shaft move up and down. The simplest solution consists of using a threaded rod 80 as a shaft, whereas the motor makes the rod turn in order to move the pressure element up and down (in a non-limiting manner). For performing the movement with controlled pressure, the mechanical drive preferably has its own motor 54 integrated in the massage unit 10, such that it moves with the assembly.

The device shown in FIG. 9 consists of inverted U-shaped guide means 70 made up of a single guide reproducing the path of the colon.

In contrast, the example of FIG. 10 shows three independent straight sections which together form the guide means 70, one massage unit 10 being linked to each of said straight sections. In other words, a single massage unit 10 travels along each of the sections 21, 22, 23 of the colon 20 of the patient 1.

In the third embodiment shown in FIG. 11, the parallel vertical guides G1 and G2 arranged at opposite ends of the support plate 30 serve as a vertical guide for a transverse guide Gt bearing a massage unit 10. The transverse guide Gt can move vertically along the vertical guides G1 and G2, and the massage unit 10 can move transversely along the transverse guide Gt. The assembly of vertical guides G1 and G2 and transverse guide Gt forms the guide means 70 and they allow the massage unit 10 to move following the path of the colon 20 of the patient 1.

The translational movement and motion of the massage unit 10 is produced by the translational means 50, which can consist, for example, of a rack-type system or a toothed rail (FIG. 12) arranged along the guide means 70 and on which gears 52 driven by means of a motor 51 engage. In another alternative embodiment shown in FIG. 13, a belt 58, which can be a cogged belt, runs parallel to the guide means 70, the massage unit 10 being attached to said belt 58, which is driven by means of a motor (not shown) fixed to the support plate 30, causing the dragging of the massage unit 10. In another alternative embodiment, the belt 58 is fixed by its ends and the drive motor is mounted on the massage unit 10.

The inclusion of several conducting guides 57 for carrying data and electricity to the massage unit 10 is also envisaged.

For the correct operation of the abdominal massage apparatus in any of the described embodiments, the apparatus will have data storage and processing units that provide flexibility for reproducing several types of massages, i.e. different massage sequence patterns. The massage patterns are codified as a combination of force evolution during time, actuator unit activation sequence and duration and frequency of actuation for each actuator. The combination of these parameters allows to perform the mentioned types of massage such as: a pressure wave translating along the trajectory of the colon 20, a pressure turbulence pattern, a pressure gradient along the ascending 21 and descending 23 sections of the colon 20 with its maximum in the transverse section 22 of the colon or a pressure decreasing gradient along the trajectory of the colon 20 among other possible patterns. The different types of massages to be given to the patient 1 can be stored in an internal memory of the control means 68 (or alternatively in a memory external thereto, for example, stored in the Cloud) and be loaded by means of applying control software including a series of code instructions for performing the abdominal massage.

The abdominal massage apparatus is able to reproduce manual massages given by professionals for treating the symptoms of constipation. The apparatus can store different types of massages from among which the patient 1 or another user may select the massage he/she wishes to receive, for example, by means of the mentioned control buttons 69 of the control means 68. Alternatively, the massage may be selected by means of using an independent smart computing device such as a smartphone, a tablet or a computer connected to the abdominal massage apparatus. In yet another alternative, the massage may be selected by means of a control panel integrated in the apparatus itself.

Massages can be loaded into the apparatus by the patient 1 him/herself or by a medical professional responsible for supervising the procedure through the control means (in any one of the alternatives thereof) or alternatively by means of using a smart computing device. The different types of massages are preferably stored in file format. To prepare these files, data from manual massages performed by healthcare professionals can be captured. The data obtained from massages is subsequently analyzed and processed for optimal storage and use by the software application of the apparatus.

The generated files contain the information needed for the apparatus to reliably reproduce the manual massage. Some of the stored parameters are: pressure applied over time in different areas of sections 21, 22, 23 where the massage will be given, location and movement of pressure/pressures over time, etc.

The massage will be adjustable, offering different options for regulating duration, speed/frequency and intensity/magnitude. Intensity/magnitude of the massage is understood as the range of controlled pressures applied, which can comprise pressures ranging from 0.01 to 1 kg/cm2 and at most limited to 4 kg/cm2. Typical frequency of operation is planned to be between 0.1-0.9 cycles per second, not limitative, as broader range of frequencies, e.g. 0.05-50 cycles per second, in order to enable variable treatment patterns during the treatment session may equally be delivered.

Furthermore, and for the purpose of preventing injury to the patient 1, the apparatus can have pressure sensors (for example, force-sensing resistor—FSR-, pressure cells or piezoelectric sensors) monitoring at all times the pressure applied on the patient 1. The information picked up by the pressure sensors can be used to regulate the intensity of the massage together with the parameters entered by the patient 1 or another user. If the pressure sensors report a value exceeding the safety limits allowed by the apparatus, said apparatus can emit, in one embodiment, an alarm sound. Likewise, if the pressure limit is exceeded for a time period of more than 5 seconds, the apparatus stops the massage and returns to a rest state.

The apparatus can capture and store data from massage sessions performed and store it in the data unit of the control means 68 or alternatively of a smart computing device. The apparatus can even send the captured and stored data to an external device or server through cable communication or by means of a wireless connection. Preferably, the information captured by the apparatus is: an identifier of the massage performed, the patient receiving the massage, duration of the session, a 3D map of pressures applied during the massage, mean pressure of the areas of maximum pressure and times of operation of the apparatus, among others. This information will allow a healthcare professional to monitor the progress and compliance of the patient 1 with the prescribed treatment, and even to make necessary adjustments to said treatment depending on the information received. Professionals may furthermore remotely configure the apparatus for the comfort of the patient 1 and agility of the follow-up process.

What is claimed is:

1. An abdominal massage apparatus, comprising:

one or more support plates configured to be secured to a patient in such a way that in use the one or more support plates face an abdominal wall of a body of the patient;

one or more massage units supported on the one or more support plates, each of the one or more massage units comprising a fluid driven actuator that includes a flexible casing for performing an abdominal massage to the patient, when the abdominal massage apparatus is in use on the patient, the one or more massage units rest against an abdominal wall of the patient in alignment with an ascending section and a descending section of the colon of the patient;

the one or more massage units being arranged to rest against the abdominal wall of the patient in alignment with only the ascending section and the descending section of the colon of the patient when the abdominal massage apparatus is in use on the patient;

a pump configured to supply a pressurized fluid to the flexible casing;

one or more valves configured to deliver or evacuate the pressurized fluid to or from the flexible casing to cause an inflation or a deflation of the flexible casing; and a control system for controlling each fluid driven actuator by controlling the pump and the one or more valves for inflating and deflating each flexible casing, the control system configured to control the pump and the one or more valves in a manner to cause a cyclic inflation and deflation of the flexible casing, the abdominal massage apparatus including at least first, second, third and fourth fluid driven actuators, the first and second fluid driven actuators being positioned on the one or more support plates such that when the abdominal massage apparatus is in use on the patient the first and second fluid driven actuators rest against the abdominal wall of the patient and are aligned in sequential locations along the ascending section of the colon of the patient such that the flexible casing of the first and second fluid driven actuators are respectively configured to apply first and second localized forces when inflated to the ascending section of the colon in a direction normal to the abdominal wall, the third and fourth fluid driven actuators being positioned on the one or more support plates such that when the abdominal massage apparatus is in use on the patient the third and fourth fluid driven actuators rest against the abdominal wall of the patient and are aligned in sequential locations along the descending section of the colon of the patient, such that the flexible casing of the third and fourth fluid driven actuators respectively being respectively configured to apply third and fourth localized forces when inflated to the descending section of the colon in a direction normal to the abdominal wall, the control system being configured to control the one or more valves to cause an application of localized forces, including the first, second, third and fourth localized forces, to only the ascending and descending sections of the colon and not to a transverse section of the colon.

2. The abdominal massage apparatus according to claim 1, wherein the control system is configured to control the at least first, second, third and fourth fluid driven actuators such that the first localized force applied by the flexible casing of the first fluid driven actuator is greater than the second localized force applied by the flexible casing of the second fluid driven actuator and the third localized force applied by the flexible casing of the third fluid driven actuator is greater than the fourth localized force applied by the flexible casing of the fourth fluid driven actuator.

3. The abdominal massage apparatus according to claim 1, wherein the pressurized fluid is an aqueous fluid, air or another gas.

4. The abdominal massage apparatus according to claim 1, wherein the flexible casing of each of the at least first, second, third and fourth fluid driven actuator is in the form of a bellows comprising two or more chambers superposed on one another.

5. The abdominal massage apparatus according to claim 4, wherein the two or more chambers associated with the flexible casing of each of the first and second fluid driven actuators each have an oblong or cylindrical shape and is oriented transverse to the course of the ascending section of the colon when the abdominal massage apparatus is in use on the patient, and wherein the two or more chambers associated with the flexible casing of each of the third and fourth fluid driven actuators each have an oblong or cylindrical shape and is oriented transverse to the course of the descending section of the colon when the abdominal massage apparatus is in use on the patient.

6. The abdominal massage apparatus according to claim 1, wherein a frequency is configured to vary along the ascending section and/or along the descending section of the colon of the patient.

7. The abdominal massage apparatus according to claim 1, wherein the one or more valves comprise electrovalves.

8. The abdominal massage apparatus according to claim 1, wherein the control system is a remotely controlled system configured to be operated by the patient.

9. The abdominal massage apparatus according to claim 1, wherein the control system is powered by one or more batteries.

* * * * *